US006279759B1

(12) United States Patent
Weisbach

(10) Patent No.: US 6,279,759 B1
(45) Date of Patent: Aug. 28, 2001

(54) MEDICATION RECORDKEEPING APPARATUS

(76) Inventor: Ruth Weisbach, 1983 Keats Ct., Highland Park, IL (US) 60035

( * ) Notice: Subject to any disclaimer, the term of this patent is extended or adjusted under 35 U.S.C. 154(b) by 258 days.

(21) Appl. No.: 08/927,957

(22) Filed: Sep. 11, 1997

(51) Int. Cl.[7] ..... A47G 29/00
(52) U.S. Cl. ..... 211/71.01
(58) Field of Search ..... 211/71.09; 40/649, 40/661

(56) References Cited

U.S. PATENT DOCUMENTS

| | | | | |
|---|---|---|---|---|
| 2,082,214 | * | 6/1937 | Osten | 211/71.01 |
| 2,179,168 | | 11/1939 | Alexander . | |
| 2,205,332 | * | 6/1940 | Aste | 211/71.01 X |
| 2,210,879 | | 8/1940 | Cahoon et al. . | |
| 2,768,457 | * | 10/1956 | Biek | 40/19 |
| 3,099,352 | | 7/1963 | Aven . | |
| 3,421,239 | | 1/1969 | Smith . | |
| 3,508,754 | | 4/1970 | Shorin . | |
| 3,731,819 | * | 5/1973 | Sandhage | 211/74 |
| 4,151,972 | * | 5/1979 | Allegro | 211/88 X |
| 4,165,709 | | 8/1979 | Studer . | |
| 4,187,628 | * | 2/1980 | Thompson | 40/661 |
| 4,191,376 | | 3/1980 | Goldman et al. . | |
| 4,240,649 | | 12/1980 | Weber . | |
| 4,241,943 | | 12/1980 | Malinovitz . | |
| 4,268,986 | * | 5/1981 | Piana | 40/661 X |
| 4,295,567 | | 10/1981 | Knudsen . | |
| 4,299,637 | | 11/1981 | Oberdeck et al. . | |
| 4,389,963 | | 6/1983 | Pearson . | |
| 4,398,708 | | 8/1983 | Goldman et al. . | |
| 4,416,375 | | 11/1983 | Braverman et al. . | |
| 4,537,312 | | 8/1985 | Intini . | |
| 4,540,175 | | 9/1985 | Coppock . | |
| 4,576,399 | | 3/1986 | White et al. . | |
| 4,634,149 | | 1/1987 | Donovan . | |
| 4,752,087 | | 6/1988 | Weisbach . | |
| 4,941,688 | | 7/1990 | Jones | 283/72 |
| 4,955,481 | | 9/1990 | Novinski et al. | 206/534 |
| 4,976,351 | | 12/1990 | Mangini et al. | 206/232 |
| 4,979,325 | * | 12/1990 | White | 40/661 |
| 5,011,189 | | 4/1991 | Olson . | |
| 5,056,824 | | 10/1991 | Olson . | |
| 5,121,563 | * | 6/1992 | Connor et al. | 40/661 |
| 5,190,319 | | 3/1993 | Sandler | 283/102 |
| 5,224,600 | * | 7/1993 | Neugebauer | 40/661 X |
| 5,230,172 | * | 7/1993 | Hsu | 40/661 X |
| 5,249,383 | * | 10/1993 | McCusker et al. | 40/661 X |
| 5,249,827 | | 10/1993 | Olson | 283/36 |
| 5,259,136 | * | 11/1993 | Goserud | 40/661 X |
| 5,664,689 | * | 9/1997 | Mirlisena, Sr. | 211/71.01 X |

FOREIGN PATENT DOCUMENTS

| | | |
|---|---|---|
| 2649645 | 5/1978 | (DE) . |
| 2904582 | 8/1980 | (DE) . |
| 2250281 | 5/1975 | (FR) . |

* cited by examiner

*Primary Examiner*—Daniel P. Stodola
(74) *Attorney, Agent, or Firm*—Patula & Associates, P.C

(57) ABSTRACT

A medication recordkeeping device comprised of a label or sheet with a plurality of characters identifying at least one subject upon which a friably removable mask covering obscures each of the characters. The label or sheet is adapted to be fixedly applied to a medication containing vessel wherein each time an individual unit of medication is consumed, the friable removable mask is removed from a character in order that the underlying subject will be exposed so that a visual record will be kept of the medication consumed. The characters may be dates, numerals or dosage amounts corresponding to a patient's needs or the particular requirements of the medication. The label or sheet preferably also includes an area for recording important information such as a patient's name or medical history. A bar code may be provided for recording relevant information. Further, the label or sheet can be inserted into a housing apparatus which attaches a medicine container thereto.

18 Claims, 5 Drawing Sheets

MEDICATION RECORDKEEPING APPARATUS

The present invention relates generally to a medication recordkeeping apparatus adapted for use in administering medication, and, in particular, to a medication recordkeeping apparatus, used with a medication-containing vessel, to visually record and indicate whether or not a dose of medication has been consumed and to precisely indicate when the dose was consumed. The present invention is an improvement over my invention disclosed in U.S. Pat. No. 4,752,087 (the '087 patent) issued to me on Jun. 21, 1988, herein incorporated by reference, and further discloses a novel holder for such an invention.

BACKGROUND OF THE INVENTION

This invention relates to a device for accurately recording and visually indicating in a convenient and inexpensive manner the consumption of doses of a medication and the precise time the dose was consumed. Many patients, while ill, have difficulty remembering whether or not they have taken their medication and many times where the patient is unconscious, a health care professional must have some accurate means of identifying whether or not a particular medication has been consumed and if so when.

The '087 patent discloses a recordkeeping indicia which allowed recordation of a consumed dosage medication by removal of a friable coating associated with that dosage. However, problems are presented when the indicia of the '087 patent are employed on a container which is kept in a patient's pocket or purse, or when the container is kept with other medications in a drawer in that the friable coatings are often inadvertently removed by contact with objects or containers there adjacent. The integrity of the recordkeeping indicia is thereby jeopardized.

The principal object of the present invention is to provide a simple, inexpensive and accurate visual method and apparatus for recording a patient's consumption of a medication in direct or close proximity to the medication containing vessel while being connected to the vessel.

It is a further object of this invention to assist a patient who is consuming more than one medication by providing a physical recordkeeping device to prevent confusion as to which medications they have consumed and when. Additionally, for nurses and other health care providers caring for a large number of patients, the present invention provides an accurate and easy method of medication recordkeeping administered to each patient.

A further object of this invention is to provide a medication recordkeeping device which protects the integrity of the recordkeeping data.

A further object of this invention is to provide a medication recordkeeping device of inexpensive manufacture adaptable to many forms of medications as well as consumption occurrences and dosages as desired.

Numerous other advantages and features of the invention will become readily apparent from the detailed description of the preferred embodiment of the invention, from the claims, and from the accompanying drawings, in which like numerals are employed to designate like parts throughout the same.

SUMMARY OF THE INVENTION

The present invention comprises an inexpensive and accurate method and apparatus for recording the consumption of a medication and being associated with the vessel containing the medication. In the preferred embodiment of the invention, the invention consists of an adhesively backed label embossed or printed with characters which are coated with a friably removable coating. The characters may be symbols referring to either numerals or letters which may represent dates, dosage amounts or occurrences of consumption. The friable coating is removed from the label exposing the character or symbol beneath providing a permanent visual record of the medication consumed. Such a label may be placed upon the medication-containing vessel preferably on the side of the container opposite the prescription label. The label preferably contains a space for the patient's name, as well as important medical information, and/or a bar code for recording and/or providing important information. In an alternative embodiment the label may be provided with an indicia protective sheet which covers the label and the friable coatings so that said coatings are not inadvertently removed. The cover is preferably clear to allow viewing of the recordkeeping indicia and is easily removed from and replaced onto the label for ease of recording consumption of a dosage.

In another alternative embodiment, the invention consists of a sheet instead of a label which is utilized in close proximity to the medication and patient. The sheet, like the label is comprised of characters and numerals masked by a friable removable coating which is removed upon consumption of medication. The sheet is preferably connected to the medication container via a housing apparatus, so that the sheet cannot readily be separated from the medication container. The housing apparatus may be provided with a displacable sheet cover to prevent unintended removal of the friable coatings while allowing easy recordation of consumed dosages.

The invention affords ready adaptability to any number of dosages to be administered to a patient. The invention is generally tamper proof, because once the coating is removed from the label or sheet exposing a character it may not be recoated. Additionally, manufacture is intended to be of an inexpensive nature such that the label may be readily applied to the medication containing vessel, or readily slipped into the housing container and attaching the medication container thereto.

BRIEF DESCRIPTION OF THE DRAWINGS

Further understanding of the foregoing may be had by reference to the accompanying drawings wherein.

DESCRIPTION OF THE PREFERRED EMBODIMENT OF THE INVENTION

Figure 1:
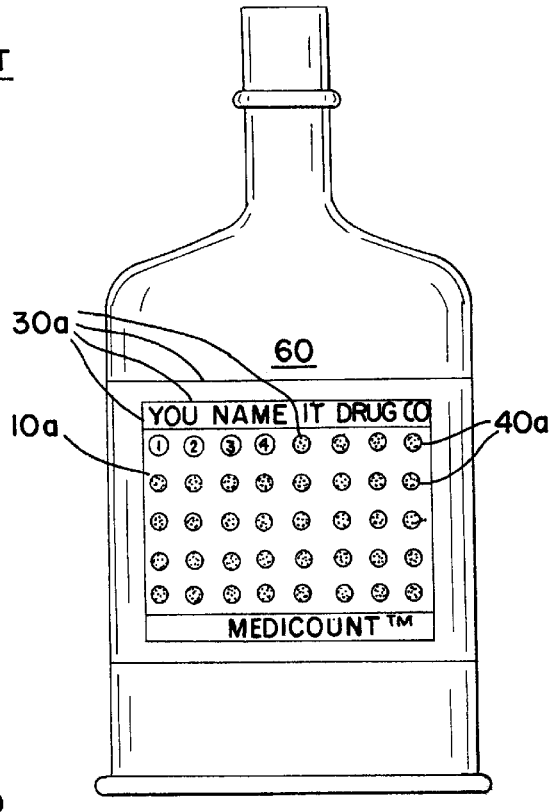
FIG. 1 PRIOR ART
FIG. 1 is a perspective view of a prior art medication recordkeeping apparatus.

While this invention is susceptible of embodiment in many different forms there is shown in the drawings and will be described herein in detail, a preferred embodiment of the invention. It should be understood, however, that the present disclosure is to be considered an exemplication of the principles of the invention and is not intended to limit the spirit and scope of the invention and/or claims of the embodiment illustrated.

Referring now to FIG. 1, a perspective view of a prior art medication recordkeeping apparatus is shown wherein a label 10*a* is adhesively affixed to a medicine bottle 60 in which four dosages have been consumed as indicated by the removal of the friable removable coating from the first four characters 30*a*.

Figure 2:
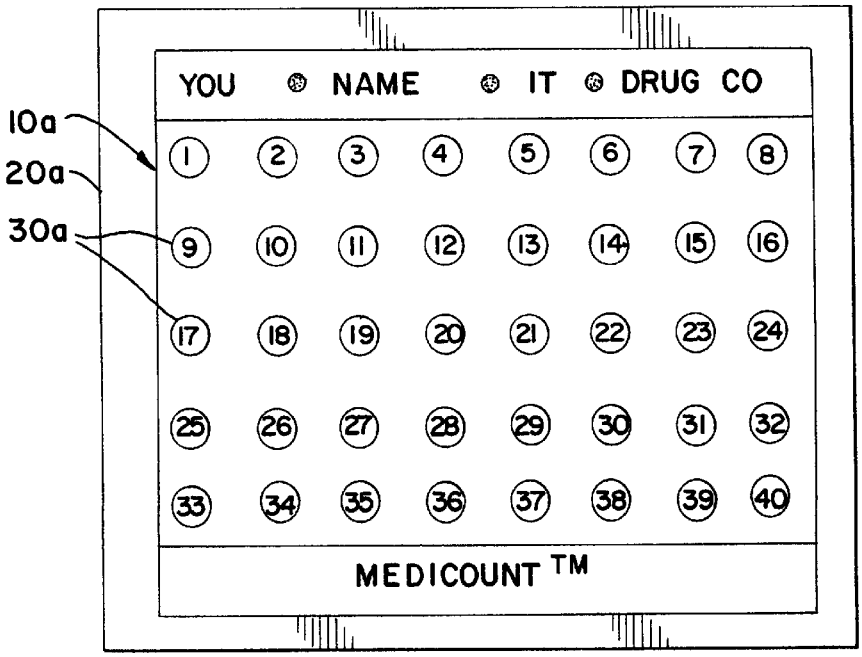
FIG. 2 PRIOR ART
FIG. 2 is a front view of the prior art apparatus of FIG. 1, characters imprinted and without the friable removable coating.

FIG. 2 is a front view of the prior art apparatus with characters imprinted or embossed onto label 10*a* without the friable removable coating. This label or sheet may be coated in a conventional manner with a friable removable coating so that it may be readily applied to a medication containing vessel.

Figure 3:
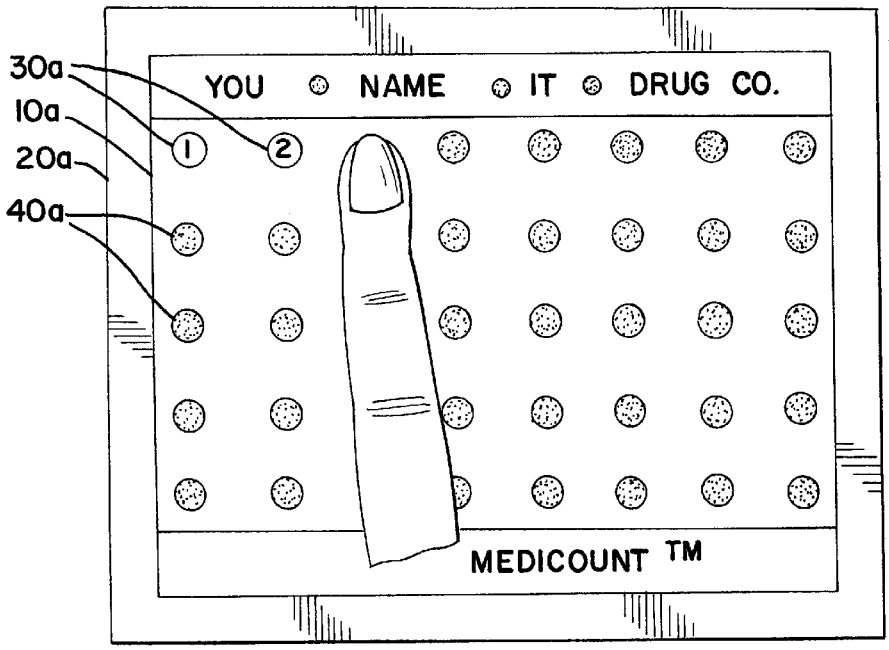
FIG. 3 PRIOR ART
FIG. 3 is a front view of the prior art apparatus of FIG. 1 with the characters imprinted on a sheet and coated with a friable removable coating in which the first two characters are exposed and a third is about to be removed.

FIG. 3 is a front view of the prior art apparatus with characters imprinted or embossed upon sheet 10*a* coated with a friable removable coating in which a user is attempting to expose a third character signifying a consumption of a third dosage of medication. The conventional friable removable coating may be removed through the use of a coin, writing instrument or a dull edge of a fingernail.

Figure 4:
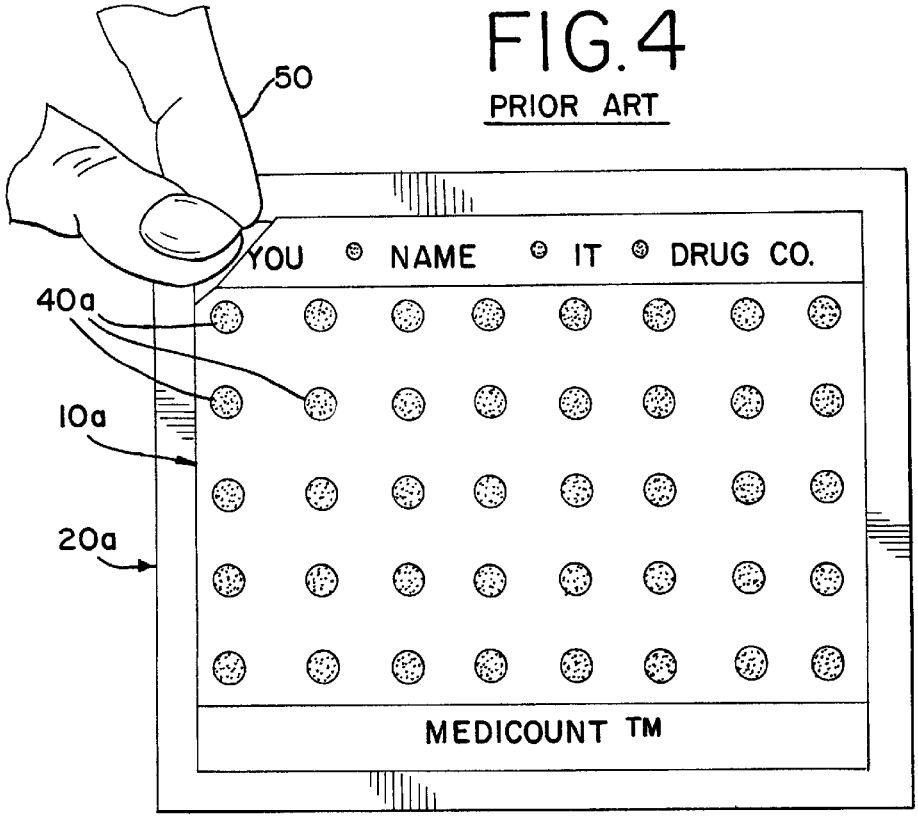
FIG. 4 PRIOR ART
FIG. 4 is a front view of the prior art apparatus of FIG. 1 with the characters fully masked by the friable removable coating, in which the label is in the process of being removed from the protective backing to reveal the adhesive backside.

FIG. 4 is a front view of the prior art apparatus with characters 30*a* fully masked by the friable removable coating 40*a* on label 10*a* in which a user is preparing the label for application to a medication containing vessel such as a bottle as shown in FIG. 1 in which the label is peeled up and away from its backing to reveal adhesive backside for application to a vial.

FIG. 1 is a perspective view of the prior art medical recordkeeping indicia label 10*a* applied to a medication containing vessel 60 in which characters 30*a*, shown generally, are exposed on label 10*a*. A friable removable coating 40*a* is shown coating the majority of characters 30*a* on label 10*a*.

FIG. 2 is a front view of the prior art label 10*a* disposed on sheet 20*a* in which characters 30*a* shown generally are embossed or printed upon said label 10*a*. The friable removable coating as shown in the accompanying figures is not shown in FIG. 2.

FIG. 3 is a front view of the prior art label 10*a* and sheet 20*a* in which characters 30*a* are embossed or printed on label 10*a*. A friable removable coating 40*a* is shown generally covering the majority of the characters 30*a*. A fingertip or fingernail 50 is shown removing the friable removable coating 40*a* from character 30*a*. The friable removable coating 30*a* is removed from the first two characters identifying the numerals 1 and 2 in which a third character is in the process of having the coating removed by fingertip 50. The remaining characters 30*a* are coated with a friable removable coating 40*a*. When label 10*a* is not removed from sheet 20*a*, it can be used in proximity to a medication-containing vessel although not attached thereto. However, in such an instance, the sheet 20*a* can easily be lost or separated from the vessel with potentially dire consequences.

FIG. 4 is a front view of prior art label 10*a* fixedly adhered to sheet or backing 20*a* in which characters 30*a* are entirely masked by friable removable coating 40*a*. Fingertips 50 are in the process of removing label 10*a* from backing sheet 20*a* in order that label 10*a* be removed from sheet 20*a* to be placed and adhered to on a medication containing vessel 60 as shown in FIG. 1.

Figure 5:
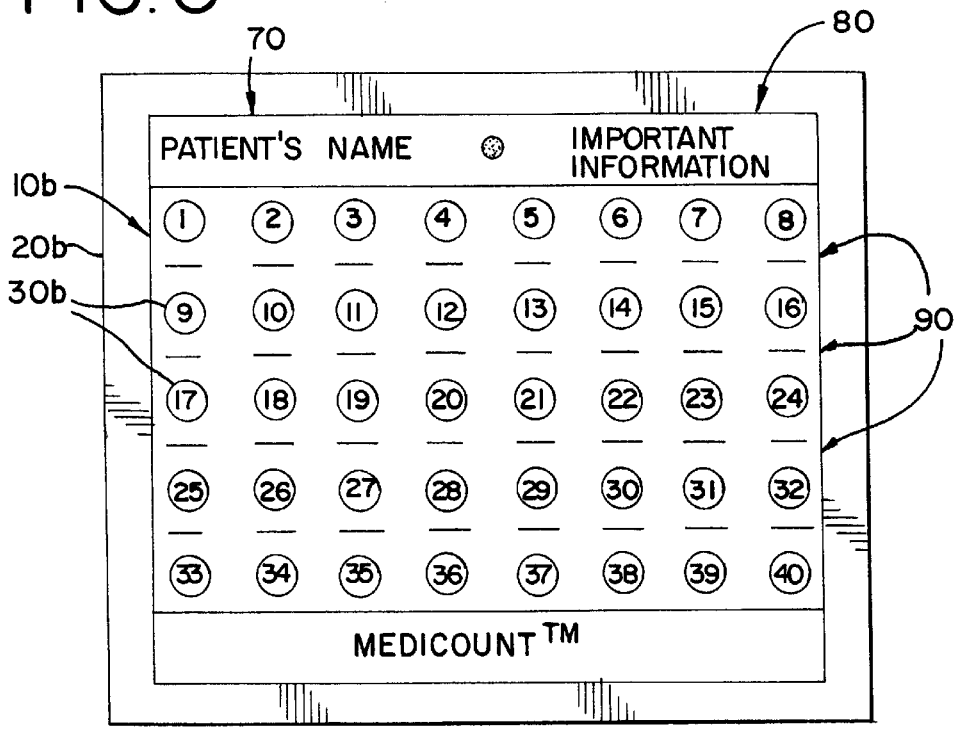
FIG. 5 is a front view of one embodiment of the present invention.

FIG. 5 illustrates one embodiment of the present invention wherein label 10*b* includes area 70 for printing a patient's name. Similarly, label 10*b* includes area 80 for printing important information of the patient, for example important medical history, allergies, or warnings not to administer certain medication which may be harmful or incompatible with other medications. Accordingly, label 10*b* can be personalized to an individual patient, thus preventing confusion or mix-ups as to which label goes with whose medication. Further, label 10*b* of FIG. 5 is also provided with data recording lines 90 wherein important data can be inscribed in addition to characters 30*b*. For example, the exact time when a dosage was administered can be written down, as well as the initials of the person who administered the dosage. This information can be useful in preventing hourly dosages from being administered in too short of time. Further, if a nurse on one shift had an important question for the person who administered a dosage on an earlier shift, that person could be readily identified and contacted.

Figure 6:
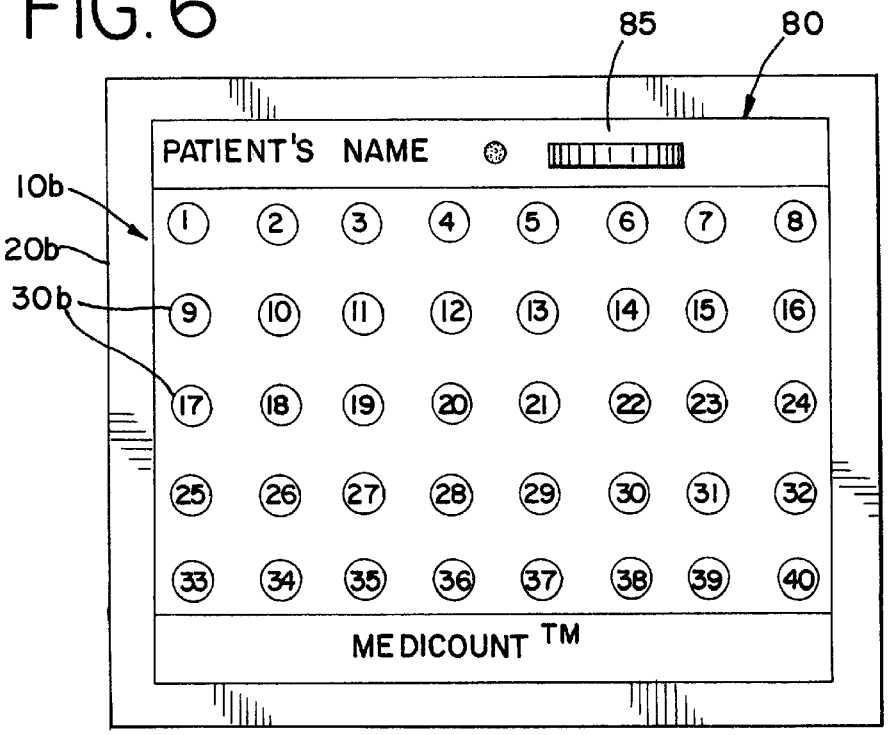
FIG. 6 is a front view of another embodiment of the present invention.

FIG. 6 illustrates an alternate embodiment of FIG. 5 wherein area 80 includes a bar code 85. Bar code 85 could contain the patient's important information such that when bar code 85 is scanned, the patient's important information is provided on a display. Additionally, each time a dosage is provided, the bar code 85 can be scanned to automatically record the date and time of the dosage.

Figure 7:
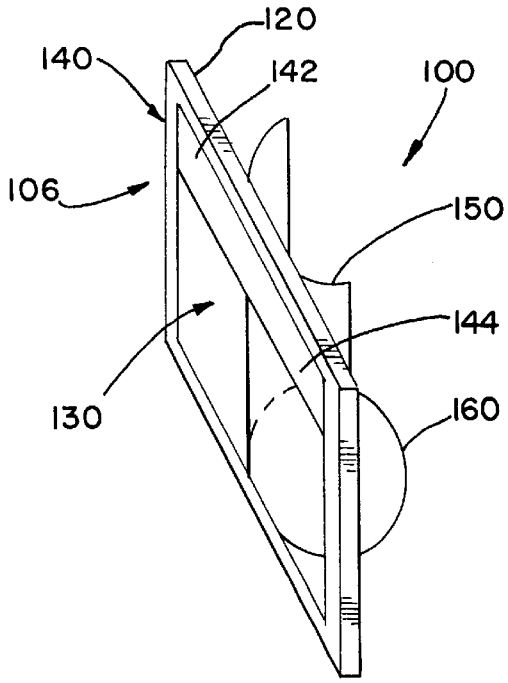
FIG. 7 is a side perspective view of the housing apparatus of the present invention.

FIG. 7 is a perspective view of the housing apparatus 100 of the present invention. Because label 10*b* could be too large to be applied to a small medicine vessel, label 10*b* can be affixed to sheet 20*b* and used in close proximity to the vessel. However, the sheet 20*b* may become separated from the vessel or lost. Thus, housing apparatus 100 is provided for housing sheet 20*b* therein and thus preventing sheet 20*b* from being separated from a small vessel.

Housing-apparatus 100 includes frame 110 having an open slot 120 for insertion of sheet 20 therein, and a display window 130 for displaying label 10*b*. Housing apparatus 100 may also contain an information area 140 having a name area 142 and an important information area 144 which could include a bar code 146 therein. Frame 110 is mounted to a mounting bracket 150. Mounting bracket 150 includes a bottom mount 160 and is designed to receive a medicine container.

Figure 8:
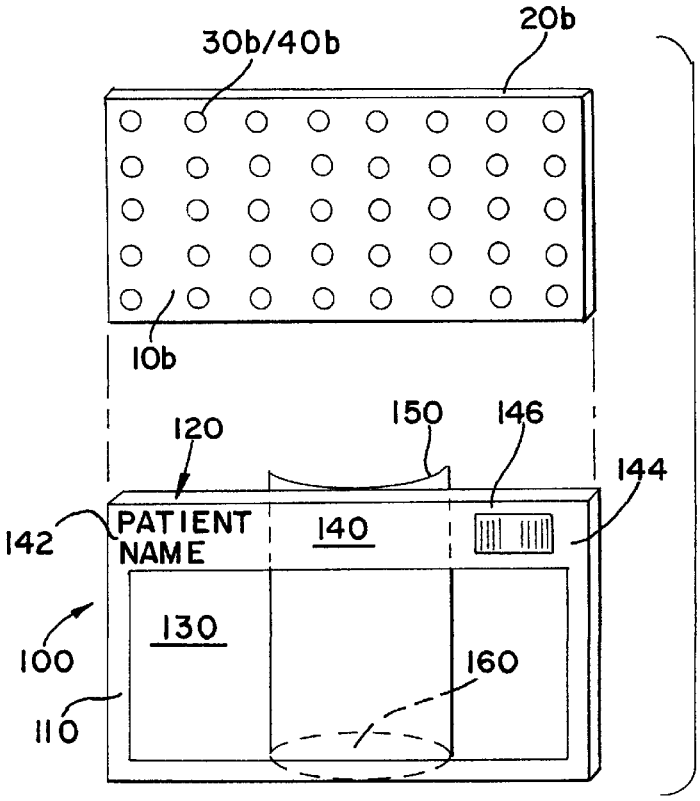
FIG. 8 is a front perspective view of the housing apparatus of the present invention, with the sheet of FIGS. 5 or 6 positioned for insertion therein.

FIG. 8 illustrates an exploded front perspective view of the housing apparatus 100 and sheet 20*b*. Sheet 20*b* is to be inserted in slot 120 of frame 110. Label 10 can then be seen and accessed through window 130. Information area 140 can include a name area 142 and important information area 144, which can include bar code 146. Frame 110 is mounted to bracket 150 having mount 160 shown in phantom. Preferably, though not necessarily, the window 130 can comprise a clear indicia protective cover 135 to protect the friable coatings on the sheet 20*b* from being inadvertently removed. The indicia protective cover 135 is preferably clear to allow a patient to view which dosages have and have not been consumed. The idicia protective cover 135 may be attached to the frame 110 in which case the sheet 20*b* would be displaced from the frame 110 to remove a friable coating when a patient has taken an associated dosage. Alternatively, the indicia protective cover 135 may be removable from the frame 110 thereby allowing removal of the friable coatings through the window 130 when a dosage has been consumed.

Figure 9:
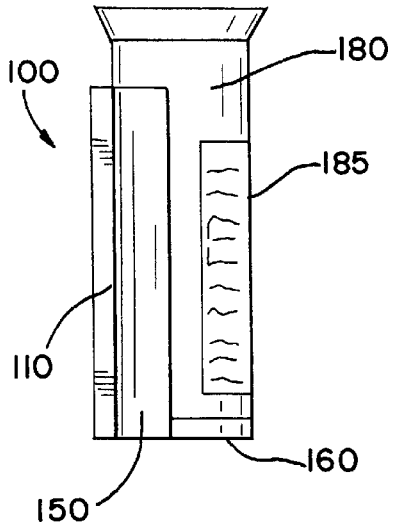
FIG. 9 is a side view of the housing apparatus with medication container attached.

FIG. 9 illustrates a side view of housing apparatus 100 having a medicine container 180 mounted thereto. Frame 110 is mounted to mounting bracket 150 having bottom mount 160, which receives container 180. In this manner, label 10*b* can be placed on sheet 20*b* and inserted in frame 110 to remain in close proximity to container 180, while the container label 185 remains free to be read.

Figure 10:
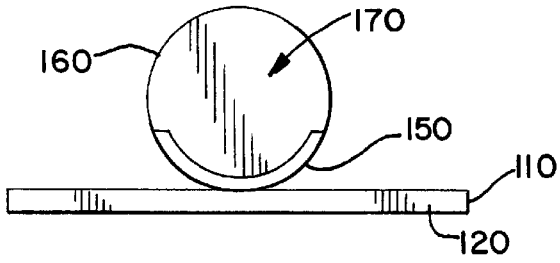
FIG. 10 is a top view of the housing apparatus of the present invention.

As can be seen in FIG. 10, housing apparatus 100 preferably includes a means 170 on bottom mount 160 for removably fastening the medicine container 180 thereto. Means 170 could be any suitable fastener such as adhesive, which would selectively hold the container 180 until removed by a user.

Figure 11:
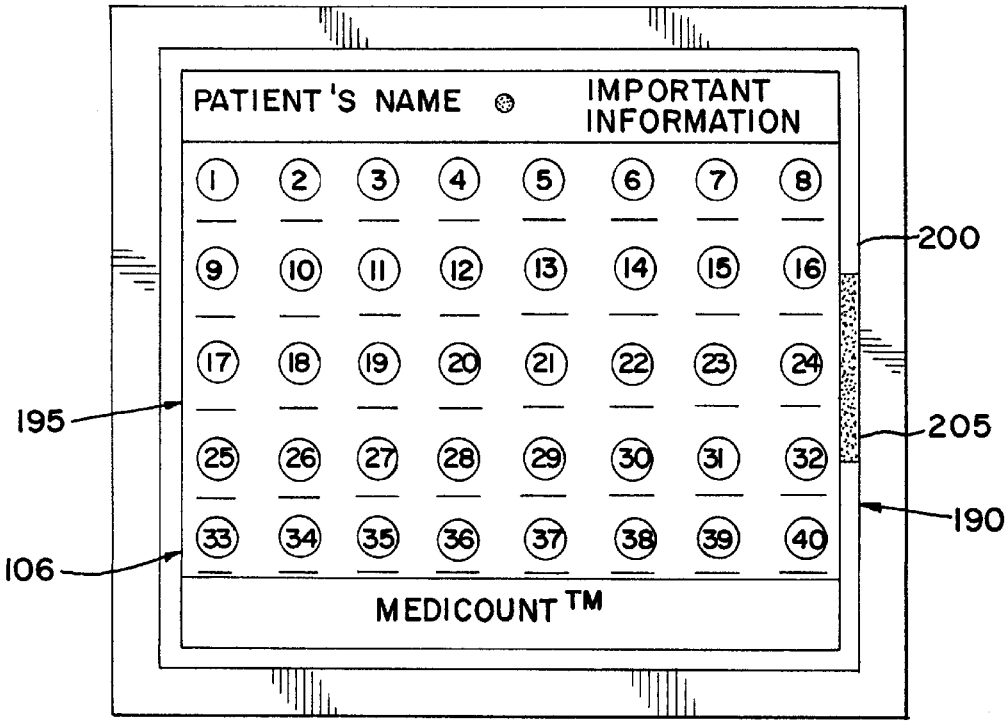
FIG. 11 is a front view of an alternative embodiment of the present invention having a protective cover over the label.

FIG. 11 illustrates another alternative embodiment of this invention wherein the label 10*b* is provided with a removable indicia protective cover 190 to protect the friable coatings from being inadvertently removed from the label 10*b* due to contact with objects stored adjacent to the medicine bottle 60 upon which the label 10*b* may be affixed. The removable indicia protective cover 190 is preferably constructed to be clear so that a patient may view the label 10*b* there through and discern which dosages of medication have been consumed. The removable indicia protective cover 190 is preferably attached to the label 10*b* at only one side 195 of the label 10*b*. The removable indicia protective cover 190 may therefore be lifted from the label 10*b* by a free side 200 of the removable indicia protective cover 190 to expose the label 10*b* and the friable coatings thereon. The appropriate friable coating may then be removed to indicate the consumption of a medicinal dosage and the removable indicia protective cover 190 replaced over the label 10*b*. The removable indicia protective cover 190 may be kept adjacent to the label 10*b* by an adhesive means 205 located adjacent to the free end 200 of the removable indicia protective cover 190. Alternatively, the removable indicia protective cover 190 may be kept adjacent to the label 10*b* by creating an electro-static or other molecular force known in the art between the removable indicia protective cover 190 and the label 10*b* or between the removable indicia protective cover 190 and the medicine bottle 60.

The foregoing specification describes only preferred embodiments of the invention as shown. Other embodiments may be articulated as well. The terms and expressions therefore serve only to describe the invention by example only and not to limit the invention. It is expected that others will perceive differences which while differing from the foregoing, do not depart from the spirit and scope of the invention herein described and claimed.

What is claimed is:

1. A medical recordkeeping label and container housing apparatus for a medical recordkeeping label and a medicine container in proximity, said apparatus comprising:

a frame for removably receiving and housing a medical recordkeeping label;

a mounting bracket attached to said frame, said mounting bracket including a bottom mount;

means for removably fastening the medicine container to said mounting bracket;

whereby said bottom mount removable receives said medicine container such that said label remains in proximity to said container while said container is affixed to said bottom mount.

2. The housing apparatus of claim 1, wherein the frame has an open window located therein through which the medical recordkeeping label may be viewed and accessed, and the housing apparatus further comprises a removable protective cover adjacent to said window for protecting the medical recordkeeping label.

3. The housing apparatus of claim 1, wherein said frame includes means for identifying patient information.

4. The housing apparatus of claims 3, wherein said means for identifying includes a patient's name.

5. The housing apparatus of claim 3, wherein said means for identifying includes a patient's medical history.

6. The housing apparatus of claim 3, wherein said means for identifying is a bar code.

7. The housing apparatus of claim 1, wherein said mounting bracket is adapted to abut less than one half of said container such that a label on said container remains free to be read.

8. A medication recordkeeping apparatus comprising in combination:

a medical recordation label;

a frame having a slot for receiving said label, and an open window through which said label can be viewed and accessed; and a mounting bracket affixed to said frame for removably attaching a medicine containers; and means for removably fastening the medicine container to said mounting bracket.

9. The apparatus of claim 8, wherein said frame includes an information area for receiving a means for identifying patient information.

10. The apparatus of claim 9, wherein said means for identifying includes a patient's name.

11. The apparatus of claim 9, wherein said means for identifying includes a patient's medical history.

12. The apparatus of claim 9, wherein said means for identifying is a bar code.

13. The apparatus of claim 8, wherein said mounting bracket is adapted to abut less than one half of said container such that a label on said container remains free to be read.

14. The apparatus of claim 8, wherein said label includes an information area receiving a means for identifying patient information.

15. The apparatus of claim 14, wherein said means for identifying includes a patient's name.

16. The apparatus of claim 14, wherein said means for identifying includes a patient's medical history.

17. The apparatus of claim 14, wherein said means for identifying is a bar code.

18. The apparatus of claim 8, wherein said label includes a plurality of characters covered with a friable removable coating, and a plurality of data recording lines associated with said plurality of characters.

* * * * *